United States Patent [19]

Mackenzie

[11] 4,310,300

[45] Jan. 12, 1982

[54] FURNACE FOR PORCELAIN ENAMELING

[75] Inventor: Peter B. Mackenzie, Fonthill, Canada

[73] Assignee: Eagle-Picher Industries, Inc., Cincinnati, Ohio

[21] Appl. No.: 182,467

[22] Filed: Aug. 28, 1980

[51] Int. Cl.[3] ..... F26B 9/12; F27B 9/02; F27B 9/00

[52] U.S. Cl. ..... 432/18; 432/128; 432/147; 432/148; 432/209

[58] Field of Search ..... 432/18, 128, 147, 148, 432/209, 244; 126/91 A

[56] References Cited

U.S. PATENT DOCUMENTS

| | | | |
|---|---|---|---|
| 2,551,549 | 5/1951 | Root | 432/128 |
| 2,799,490 | 7/1957 | Rusciano | 432/209 |
| 3,880,578 | 4/1975 | Chartet | 432/243 |

*Primary Examiner*—John J. Camby

*Attorney, Agent, or Firm*—Hill, Van Santen, Steadman, Chiara & Simpson

[57] ABSTRACT

An apparatus for the continuous porcelain enameling of sheet ware including the combination, in succession, of a drying zone for the incoming ware either integral or separate, a pre-heating zone for the ware following the drying zone, a heating zone for the ware after the pre-heating zone or zones, in which the porcelain enamel coating is fused onto the surface, and a cooling zone or zones. Burner means are provided for introducing hot combustion gases into a serpentine tube radiant heater which is in the heating zone to heat the ware by means of flameless radiation. After leaving the heating zone, the hot combustion gases are directed into the final pre-heating zone where they transfer some of their heat to the ware passing through that zone. Finally, the combustion gases leaving the pre-heating zone are directed into the drying zone where they transfer heat by convection to remove moisture and slightly pre-heat the ware, whereupon the relatively cool combustion gases are exhausted from the drying zone.

The present invention also contemplates a method for fusing a porcelain enamel coating onto a piece of ware by passing the ware sequentially through the aforementioned zones, passing combustion gases in countercurrent relationship to the movement of the ware, so that most of the usable heat in the hot combustion gases is used as it passes successively through the pre-heating and drying zone and the gases can be exhausted from the drying zone at a relatively low temperature.

10 Claims, 7 Drawing Figures

FURNACE FOR PORCELAIN ENAMELING

BACKGROUND OF THE INVENTION

1. Field of the Invention

This invention is in the field of continuous enameling furnaces wherein the ware is continuously passed through succeeding drying, pre-heating, heating and cooling zones while hot combustion gases which serve to fuse the pre-applied coating to the surface of the ware give up essentially all of the usable heat in passing from the hot heating zone into the cooler pre-heating zone, and ultimately into a drying zone for removing moisture from the incoming ware before the combustion gases are exhausted.

2. Description of the Prior Art

There have been some designs of continuous enameling furnaces using radiant tubes of straight and U tube configurations. The exhaust in such furnace assemblies generally went out straight through the stack into a collector hood. The very high temperature of the gases made it difficult to dispose of or salvage the heat from the combustion gases properly and this added considerably to the cost.

There are also continuous enameling furnaces of the muffle furnace type using a refractory lining which is heated from behind by means of burners. This type of assembly exhausted the combustion gases under the floor of the furnace to a flue which extended through the roof. Since the exhaust gases were frequently at a temperature as high as 1800° F., the problem of waste gas disposal was acute. Some attempts were made to use heat exchangers in the stack but, to my knowledge, these were not successful.

SUMMARY OF THE INVENTION

The present invention provides an improved apparatus for a continuous enameling furnace in which there is no direct impingement of flame or exhaust products on the ware except in the dryer, thereby reducing the possibility of contamination or localized overheated spots. The entire heating process occurs in the furnace, and much of the useful heat is recovered. Furthermore, there is provided a pressure control system which minimizes the chimney effect which might otherwise occur in an installation utilizing a continuously moving overhead conveyor for moving the ware through the various stages of the furnace. The use of a combination of radiant heat in the very hot portion of the furnace, and convective heat transfer, together with some radiation in the preceding stages, makes possible a very efficient use of the sensible heat contained in the hot combustion gases.

In general, the furnace assembly of the present invention provides a combination of a drying zone for incoming ware, pre-heating zone or zones for ware following the drying zone, a heating zone for the ware after the pre-heating in which the coating previously applied to the ware is fused thereon, and a cooling zone following the heating zone. The heating zone includes a serpentine tube radiant heater which provides flameless radiant heat uniformly on the surfaces of the ware passing thereby. Burner means are provided for introducing hot combustion gases into the serpentine tube heater to heat the same to a temperature sufficient to achieve the proper fusion temperature. Combustion gases are directed from the heating zone into heat exchange relationship with the ware in the preceding radiator pre-heating zone. After the combustion gases leave the radiator pre-heating zone, they enter a drying zone which is also a pre-pre-heating zone where convective heat transfer to the ware occurs. The spent exhaust gases discharge from the drying zone at a relatively low temperature.

The present invention also provides specific improvements in the preceding described system. For example, it is preferred to include an air curtain type air seal between the drying zone and the pre-heating zone, and at the conclusion of the cooling zone. These air seals serve to isolate the interior of the furnace from ambient influences. In both of these air seals, the circulating air which has been pre-heated by contact with the ware is passed into heat exchange relationship with ambient air.

Another improvement of the present invention resides in the manner in which the conveyor system is isolated so as to maintain an equilibrium condition where air is neither introduced nor exhausted through furnace openings. This reduces convective losses and maintains optimum temperature uniformity from the top to the bottom of the furnace. In the preferred embodiment of the present invention, the slot through which the ware hanger passes is subjected to currents of air at right angles to the direction of the slot, so that the tendency for the furnace gases to pass up through the slot in a chimney effect is elminated. Automatic means can be provided for sensing the difference in pressure between the high temperature heating zone and the slot enclosure to regulate the pressure differential existing between the two.

BRIEF DESCRIPTION OF THE DRAWINGS

A further description of the preferred embodiments of the present invention will be made in conjunction with the attached sheets of drawings in which.

DESCRIPTION OF THE PREFERRED EMBODIMENTS

Figure 1:
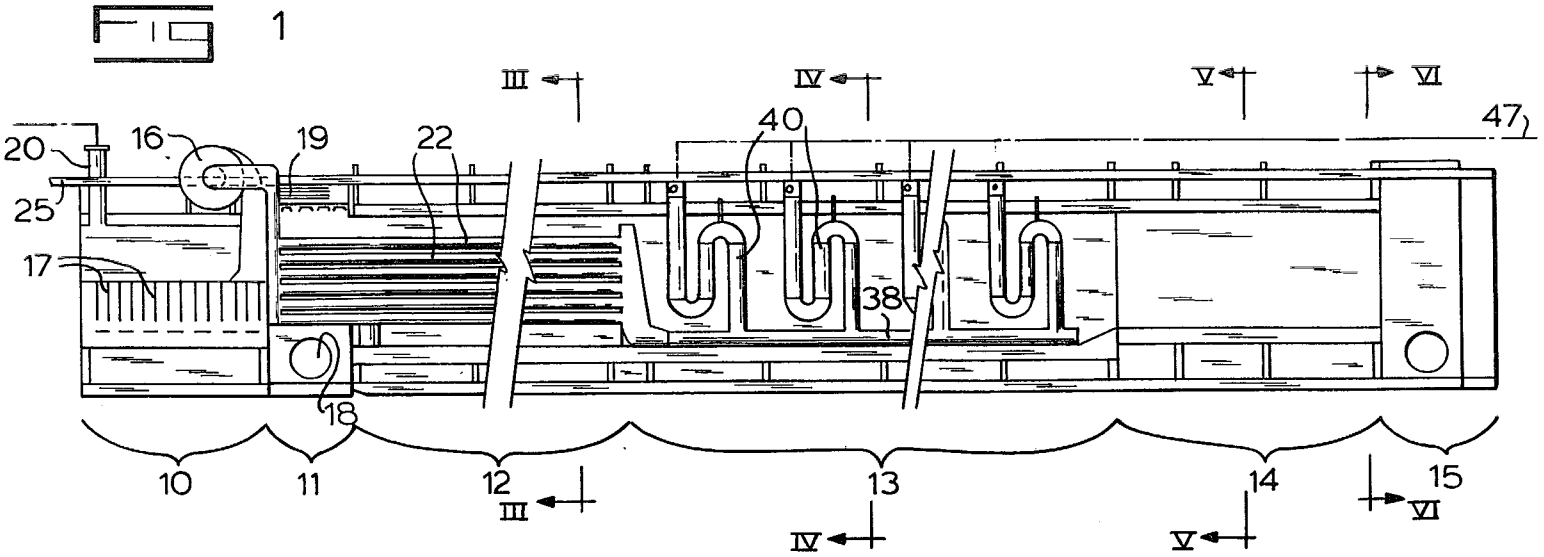
FIG. 1 is a view in elevation illustrating somewhat schematically a relatively long straight through continuous enameling furnace utilizing the improvements of the present invention.

Referring to FIG. 1, the furnace assembly of the present invention can be broken down into a series of successive stages as follows: reference 10 has been applied to a dryer zone, reference 11 to an air seal, reference 12 to a pre-heating zone, reference 13 to a heating or fusion zone, reference 14 to a cooling zone and reference 15 to an air seal. The ware travels from left to right as shown in FIG. 1.

In the drying zone 10 the ware is conveyed through an initial zone where it is contacted with hot gases supplied thereto by means of a hot fan 16 which discharges into dryer plenums 17 to serve as a heat source for removing moisture from the ware being passed therethrough. When much of the usable heat has been removed from the gas in the dryer zone, it is passed out of the system through an exhaust 20. Typically, the exhaust gases exit at temperatures of about 200 to 300° F.

The dried ware then passes through the air seal zone 11 where there is a curtain of air provided by a fan 18 to isolate that end of the furnace assembly from the ambient atmosphere. The air seal also contains a heat exchanger region 19 which transfers some of the heat of the gases entering from the pre-heating zone 12 into the circulating air stream in the air seal, before the gases are passed by the hot fan 16 into the dryer zone 10.

Figure 3:
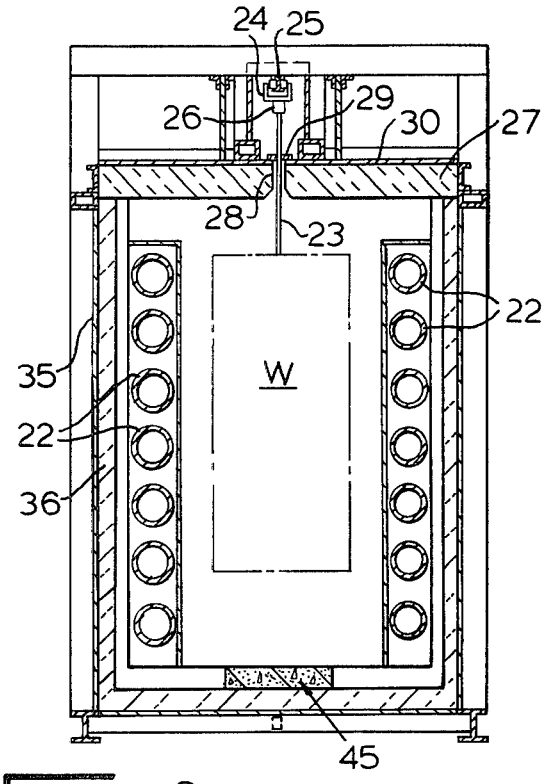
FIG. 3 is a cross-sectional view taken substantially along the line III—III of FIG. 1, and illustrating the pre-heating zone of the present invention.

After the ware W passes through the air seal 11, it goes into the radiator pre-heating zone 12 which is best illustrated in FIG. 3 of the drawings. As illustrated in that figure, the zone contains horizontally extending heat exchanger pipes 22 along both sides thereof between which the ware W passes. The ware is supported by means of a drop rod 23 which is connected to a trolley 24 propelled along a guide means such as an I beam 25 by means of a conventional chain drive 26. The roof of the furnace consists of a ceramic fibre lining 27 in which there is provided a tapered slot 28 through which the drop rod 23 extends. The drop rod also carries a shoe plate 29 which rides on a slider angle. The exterior of the furnace may consist of a furnace wall 35 and one or more insulating layers 36. The ceramic fibre floor of the furnace may include a refractory walkway 45.

Figure 4:
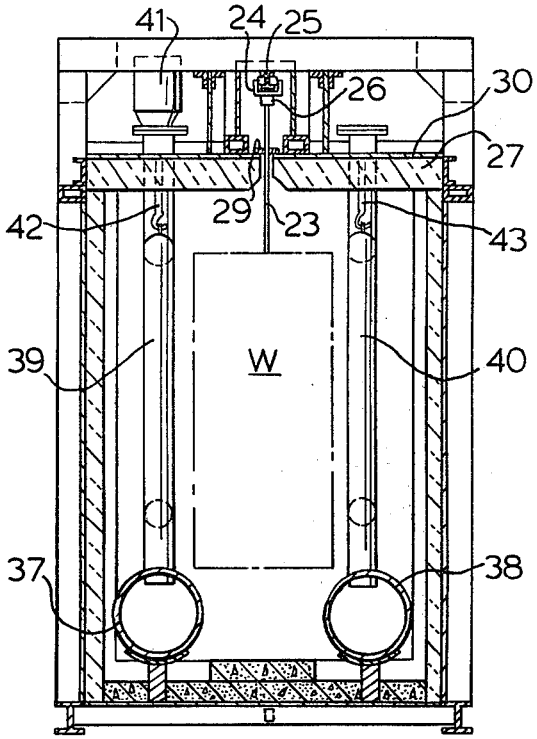
FIG.4 is a cross-sectional view taken substantially along the line IV—IV of FIG. 1 and illustrating the heating zone of the present invention.

The wave W is pre-heated in the pre-heating chamber 12 by flowing hot gases through the tubes 22, the gases originating from the succeeding heating zone 13 which is best illustrated in FIG. 4 of the drawings. As illustrated, the heating chamber includes a pair of manifold pipes 37 and 38 which receive hot combustion gases from a plurality of serpentine radiant tube units 39 and 40 on opposite sides of the furnace. These radiant tube units are, in turn, fed with the hot combustion gases from a burner 41. The radiant heater tubes are supported within the furnace by means of hanger hooks 42 and 43. In the heating zone 13, the porcelain enamel frit which had been applied to the surface of the ware as a wet deposit before being introduced into the dryer zone 10 is fused to form the porcelain enamel coating following pre-heating.

Figure 5:
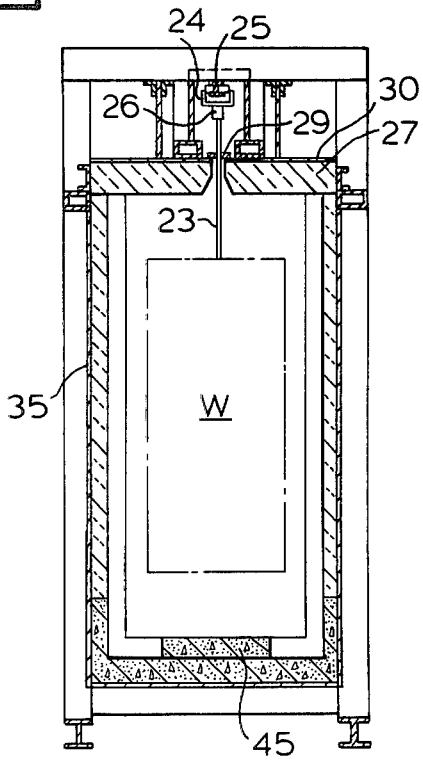
FIG. 5 is a cross-sectional view taken substantially along the line V—V of FIG. 1, and illustrating the cooling zone of the furnace.

After passing through the heating zone 13, the ware W passes into the cooling zone previously identified at reference 14 and illustrated in FIG. 5 of the drawings. In the cooling zone 14, the temperature of the ware is brought down to a value at which it can be handled conveniently.

Figure 6:
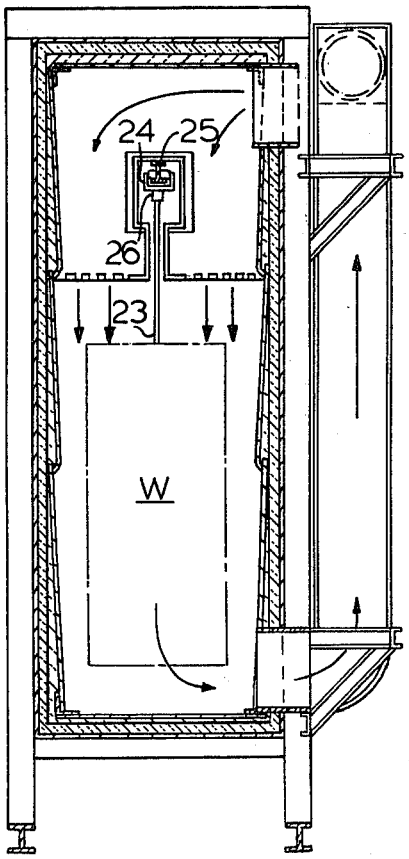
FIG. 6 is a cross-sectional view taken substantially along the line VI—VI and illustrating the air seal following the cooling zone.

Finally, the ware passes through the exit air seal zone 15 best illustrated in FIG. 6 of the drawings. A circulating curtain of air is provided by means of a circulating fan 46.

Figure 2:
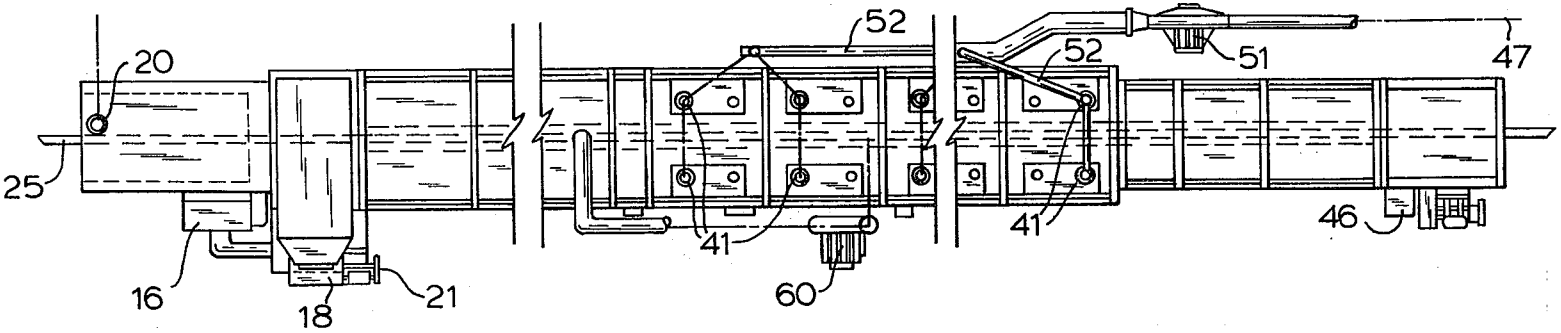
FIG. 2 is a plan view of the assembly shown in FIG. 1.

Outside air is drawn from a line 47 and is then passed through a combustion blower 51 best illustrated in FIG. 2 of the drawings. From there, air for combustion is supplied by means of a plurality of air supply pipes 52 to the various burners 41 located in the heating zone 13.

Figure 7:
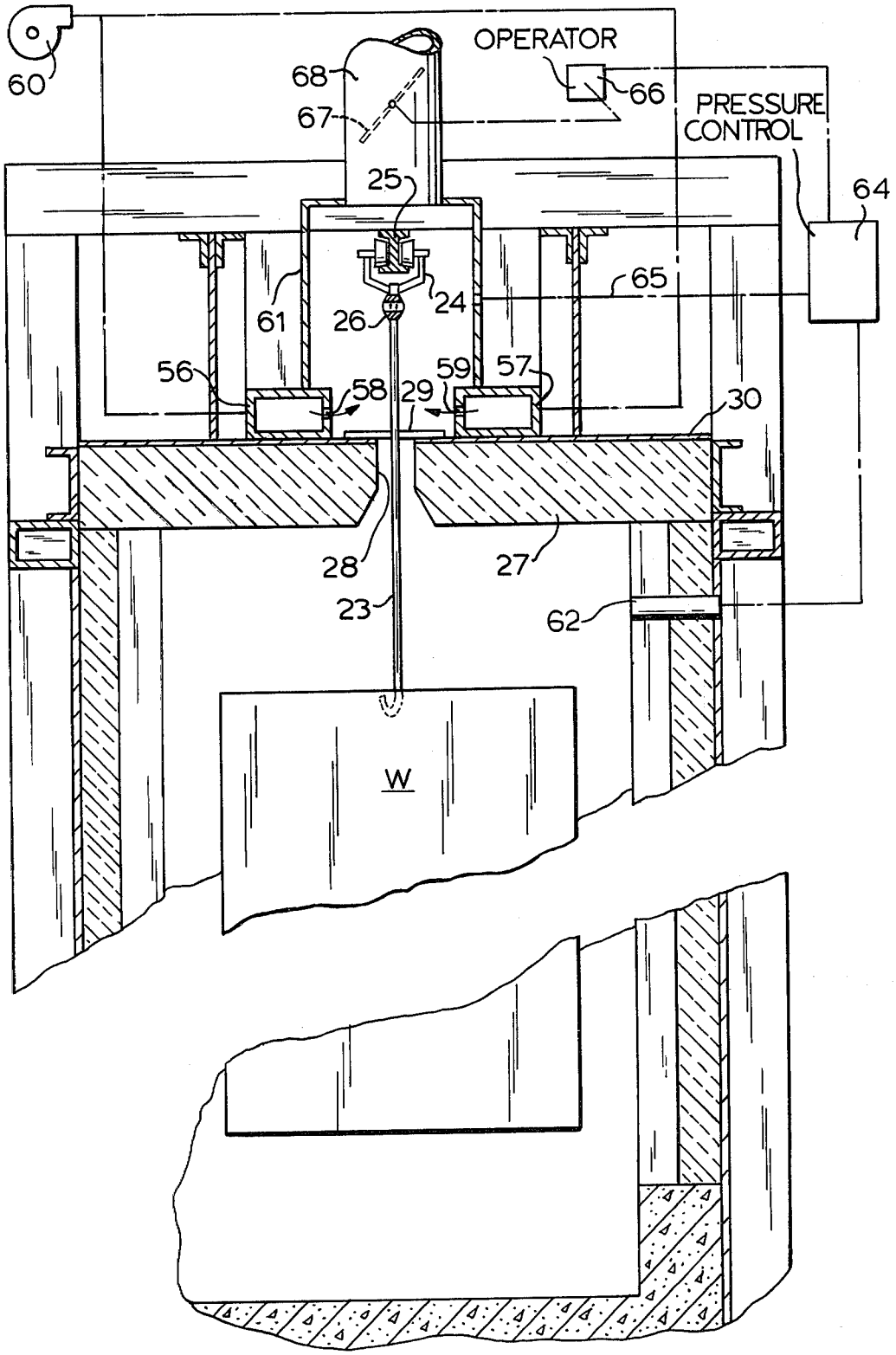
FIG. 7 is a fragmentary cross-sectional view illustrating the manner in which the pressure in the vicinity of the slot can be automatically regulated.

As the ware W moves through the furnace assembly, it is unavoidable that there will be openings for heat to escape inasmuch as the areas through which the ware W travels must be larger than the ware itself. In the present invention, this tendency for the hot furnace air to escape, particularly through the slot 28 in which the drop rod 23 is received, is minimized by providing a pair of headers 56 and 57 (FIG. 7) which are provided with spaced apertures 58 and 59, respectively. Air under pressure is supplied to the headers 56 and 57 from a blower 60 (FIG 7). The air is directed through the series of orifices 58 and 59 at right angles to the direction of movement of the ware W and substantially parallel to the shell plate 30. The air thus supplied is confined above shoe plates 29 by means of an enclosure 61. In order to automatically regulate the pressure within the confined space defined by the enclosure 61, there can be provided a sensor device consisting of a probe 62 which feeds its information to a pressure controller 64. A sensor within the enclosure 61 determines the pressure in that space and delivers its information by means of a connection 65 to the pressure controller 64. When the pressure differential between the furnace and the enclosed space within the enclosure 61 differs by more than a predetermined amount, the pressure controller 64 energizes an operator 66 which operates a control damper 67 located in a common stack 68 to thereby change the pressure relationships as required. The existence of the right angle air currents across the shoe plate 29 effectively eliminates any chimney effect which might otherwise occur through the slot.

To give an illustration of the temperatures involved in the various stages, the dryer zone 10 may operate at temperatures ranging from about 200° to 450° F., with a temperature of about 345° being typical. The temperature at the hot fan 16 may range from 300° F. upwardly to 1000° F. In the heat exchanger, the temperature of the gases may range from about 500° to 1200° F., with 900° F. being a typical value. In the exhaust manifold ducts 37 and 38, the temperatures may range from about 1350° to 1700° F., with 1550 being an average value. The temperature within the radiant tubes 39 and 40 may vary from about 1400° to 1750° F., with 1600° being typical. The furnace temperature itself will, of course, vary depending on the nature of the frit but 1300° to 1600° F. is the usual operating range, with 1500° F. being typical.

Tests have shown that the system of the present invention is able to utilize about 87 out of every 100 BTU's of gas input as compared to 50 or less from every 100 BTU's from a conventional radiant tube system or even lower in the muffle furnace system.

The internal heat recovery system used in the present invention does not contaminate the process atmosphere but exhausts gases at relatively low temperatures as compared with previous practice.

It should be evident that various modifications can be made to the described embodiments without departing from the scope of the present invention.

I claim as my invention:

1. A porcelain enameling furnace assembly comprising:

means defining a drying zone for incoming ware, means including a pair of spaced, vertical banks of conduits defining a radiator pre-heating zone between which said ware passes following said drying zone, means defining a heating zone for said ware following said pre-heating zone, means defining a cooling zone following said heating zone, conveyor means for conveying an enamel coated ware successively through said drying, pre-heating, heating and cooling zones, said heating zone including a serpentine tube radiant heater, burner means introducing hot combustion gases into said serpentine tube heater to heat the same to a temperature sufficient to fuse the enamel onto the ware by radiation, means for directing the combustion gases from said heating zone into said banks of conduits to heat the ware in said radiator pre-heating zone, means for directing said combustion gases from said pre-heating zone into said drying zone for convective heat transfer across the surfaces of said ware, and means for exhausting relatively low temperature gases from said drying zone.

2. A furnace assembly according to claim 1 which includes:

an air seal disposed between said drying zone and said pre-heating zone.

3. A furnace assembly according to claim 2 which includes:

a second air seal disposed beyond said cooling zone.

4. A furnace assembly according to claim 1 in which:

said conveyor means includes a guide means extending through said pre-heating, heating and cooling zones, hanger means for movably engaging said ware to said guide means, said pre-heating, heating and cooling zones having a continuous slot extending therethrough through which said hanger means passes in its travel along said guide means, and means for applying pressurized air above said slot to prevent gases from being exhausted therethrough from the zone below.

5. A furnace assembly according to claim 4 in which said pressurized air is introduced horizontally at right angles to the lengthwise dimension of said slot.

6. An apparatus according to claim 1 which includes:

a first air seal located between said drying zone and said pre-heating zone, a second air seal located beyond said cooling zone, both air seals including means for circulating air therein, and a heat exchanger means in the first said air seal receiving additional sensible heat to said air seal from said radiator preheat zone.

7. An apparatus according to claim 1 which includes:

at least one large diameter manifold per side receiving the combustion gases from said tube heater and directing them into said radiator pre-heating zone.

8. A method for fusing a porcelain enamel coating on a piece of ware which comprises:

passing said ware sequentially through a drying zone, a pre-heating zone, a heating zone and a cooling zone, passing combustion gases in countercurrent relationship to the movement of said ware, passing said combustion gases through a confined tortuous path in said heating zone so as to expose said ware to flameless radiant heat therein, passing the combustion gases from said heating zone into said pre-heating zone and into heat exchange relationship with said ware, passing the combustion gases from said pre-heating zone into said drying zone into direct surface contact with the incoming ware, and exhausting the combustion gases from said drying zone.

9. A method according to claim 8 which includes the step of:

establishing a curtain of circulating air between said drying zone and said pre-heating zone.

10. A method according to claim 8 which includes the step of:

establishing a curtain of circulating air beyond said cooling zone to further cool said ware.

* * * * *